US005366235A

United States Patent [19]

Eugler et al.

[11] Patent Number: 5,366,235

[45] Date of Patent: Nov. 22, 1994

[54] SKI BINDING

[75] Inventors: Norbert Eugler, Karlsfeld; Werner Schindler; Hernan H. Dominguez, both of Munich, all of Germany

[73] Assignee: silvrette - sherpas Sportartikel GmbH, Karlsfeld, Germany

[21] Appl. No.: 991,956

[22] Filed: Dec. 17, 1992

[30] Foreign Application Priority Data

Dec. 20, 1991 [DE] Germany ..... 4142434

[51] Int. Cl.[5] ..... A63C 9/083

[52] U.S. Cl. ..... 280/622; 280/637

[58] Field of Search ..... 280/619, 622, 637, 615, 280/613, 617

[56] References Cited

U.S. PATENT DOCUMENTS

| | | | |
|---|---|---|---|
| 2,685,448 | 8/1954 | Walker | 280/621 |
| 2,789,827 | 4/1957 | Knauf | 280/622 |
| 3,825,274 | 7/1974 | Weinstein | 280/637 X |
| 3,941,397 | 3/1976 | Kidder et al. | 280/637 |
| 4,142,735 | 3/1979 | Biermann et al. | 280/622 X |

FOREIGN PATENT DOCUMENTS

| | | | |
|---|---|---|---|
| 148177 | 12/1936 | Austria | 280/622 |
| 841929 | 6/1939 | France | 280/622 |
| 218104 | 3/1942 | Switzerland | 280/11.35 |

OTHER PUBLICATIONS

Krause: Konstruktionselemente der Feinmechanik, Carl Hanser Verlag München Wien 1989, Seiten 290, 291**.

*Primary Examiner*—Richard M. Camby
*Assistant Examiner*—Michael Mar
*Attorney, Agent, or Firm*—McAualy Fisher Nissen Goldberg & Kiel

[57] ABSTRACT

The heel holding device has a non-stretching tension member which is movable in every direction and constructed in the manner of a ribbon. The tension member is fastened at the ski by one end and can be fastened with its other end at a peg at the heel of the boot by means of a clamp. The tension member can be detached voluntarily by means of this clamp and can be pulled off the peg when a tensile force acts substantially in the direction of the boot sole. Two parts of a connecting piece are adjustably fastened to the tension member at a distance relative to one another. The two parts form a connecting piece which is constructed in the manner of a push button. A loop of the tension member remains in the closed state of the connecting piece, which loop leads to a lengthening of the tension member after the connecting piece is loosened when acted upon by increased tensile force, so that the boot heel can be lifted farther from the ski.

1 Claim, 16 Drawing Sheets

SKI BINDING

BACKGROUND OF THE INVENTION a. Field of the Invention

The invention is directed to a ski binding with a front sole holding device and a heel holding device which can be lifted from the ski.

b. Background Art

Bindings of this simple type are used especially in ski jumping and in their simplest form include a fixed front jaw with corresponding sole retainers to hold the tip of the boot on the ski. The sole holding device in the heel area must allow the heel to be lifted during the ski jump and particularly when landing. However, in these known bindings it has been shown that the adjustment angle between the sole of the boot and the ski can change when the ski is airborne, particularly during wind gusts, which can negatively influence not only the elegance of the jump and the attainable distance, but also the safety of the ski jumper.

OBJECT AND SUMMARY OF THE INVENTION

The object of the present invention is to enable an exact guiding of the ski during the ski jump and particularly to avoid the risk of the ski being turned up during wind gusts.

This object is met according to the invention in that the heel holding device includes a tension member which can be moved in every direction, connects the boot heel with the ski, and allows the boot heel to be lifted to a predetermined height. The movable tension member of the heel holding device can be provided either in addition to a conventional cable binding which is necessary for holding the boot in the front jaw or also by itself when the front sole holding device is constructed in such a way that it holds the boot on the ski without circumferentially extending cable, i.e. without the heel holding device. The tension member which limits the swivel angle of the boot relative to the shoe to a determined value increases stability during the jump and prevents the dangerous turning up of the ski during wind gusts.

Although such a construction brings about substantial advantages in the ski jumping phase, disadvantages occur when landing, which is currently usually carried out in the telemark style. A still greater swivel angle of the boot sole relative to the ski is necessary for this purpose so that it proves disadvantageous to limit the swivel angle to a fixed value guided by the requirements of the ski jump.

Therefore, the invention has the object not only of improving the conditions during the ski jump, but also enabling a safe landing in the telemark style. A first possibility, although not reaching the ideal state which is aimed for, consists in that the tension member exerts an increasing swivel resistance as the swivel angle of the boot increases so that the ski jumper can lift his heel still farther from the ski when landing, as required for the telemark landing, while overcoming an increased resistance. However, this solution only represents a certain compromise since there is no definitely fixed limiting of the swivel angle during the ski jump because this swivel angle can be exceeded even when an increased resistance is overcome, which is still disadvantageous during strong wind gusts.

A substantially improved solution consists in that the tension member can be loosened voluntarily and can also free the connection between the boot heel and ski when a tensile force acting on the boot heel exceeds a predetermined value. The force required to free this connection can be selected at a magnitude such that it is not exceeded during the ski jump but so that it is possible to detach this connection during the telemark landing so that the ski jumper can maintain the customary posture.

A possible advantageous construction of the tension member for realizing this idea consists in that the tension member is divided and in that the two parts of the tension member are connectable by means of a two-part connecting piece constructed in the manner of a push button.

In this construction, in which the connection between the boot heel and ski can be detached when reaching a certain swivel angle by increasing the tensile force, the fact that the boot heel can now be freely lifted might be perceived as a disadvantage under certain conditions by some ski jumpers.

In order to avoid this possible disadvantage as well, it is provided in a further development of the invention that two parts of a connecting piece which is constructed in the manner of a push button can be fastened at the tension member at a distance from one another so as to be adjustable. In its closed state, the connecting piece fixes the tension member at the length required during the ski jump and lengthens it to the length required for telemark landing after detaching the connecting piece by the application of force. This provides the ski jumper with a limiting of the swivel angle in two steps. Namely, the swivel angle is first limited to the degree which proves necessary for the ski jump and to a second degree required for performing a telemark landing without giving the ski jumper the feeling that the boot heel could be lifted to any desired extent, i.e. beyond the degree necessary for telemark landing.

The previously suggested possible solutions can also be applied in front sole holding devices not having a safety release, i.e. also in front sole holding devices which enable the boot to be completely freed from the ski.

The solutions suggested in the following are only meaningful when the front sole holding device is constructed, according to another development of the invention, as a safety holding device which releases when overloaded.

When using a front sole holding device which releases the boot from the ski when overloaded so as to prevent injury to the ski jumper it is also necessary that the tension member safely and reliably releases the boot when the latter is freed from the front sole holding device without impairing the aimed for function during the jumping and landing phases.

An advantageous construction for solving such a problem consists in that a clamp of resilient material, e.g. plastic, is provided at the end of the tension member associated with the boot heel. This clamp can be locked on a cylindrical peg between two flanges of same transversely to the peg axis in a form-fitting or positive-locking manner, the peg being arranged at the boot so as to stand vertically relative to the surface of the boot sole. Under the usual tensile loading which occurs when the boot is swiveled relative to the ski during the jumping phase and also when landing, the clamp is clamped between the flanges of the peg and can accordingly not be loosened from it. On the other hand, if a tensile loading occurs in a substantially parallel direction relative to the boot sole after the releasing process and freeing of the boot from the ski, the peg arranged at the boot can be freed from the clamp since the latter is only attachable to this peg accompanied by a slight clamping action. This ensures that the tension member will not act as a catch strap after the boot has been released from the front sole holding device and that the ski jumper is freed entirely from the ski.

In a further development of the invention, the clamp can have a gap in a plane at a right angle to the longitudinal axis of the peg so as to allow the clamp to disengage from the boot heel also when strong, excessive forces act in one direction not extending parallel to the boot sole. This gap proceeds from the end attached to the peg and extends beyond the recess provided for the peg, one end of the tension member being arranged so as to be fixed with respect to the ski, while the other end is securely arranged at the clamp. If strong tilting forces act on the clamp in this construction, the clamp can deform due to the gap so that it is no longer held in a positive-locking manner between the two flanges of the peg and can accordingly also be freed from the latter when the tension direction does not extend vertically with respect to the axis of the peg. This is not only advantageous in a complete release of the boot from the ski, but also during telemark landing when the boot heel must suddenly be lifted farther from the ski than is required in the jumping phase.

The additional suggested solutions are provided to enable a controllable increase in the swivel angle of the boot sole relative to the ski during the transition from the jumping phase to the telemark landing. The clamp already described above which enables a complete freeing of the boot from the ski is provided in every case. A clamp produced from solid material as well as a clamp which can deform due to a gap can be used.

An advantageous construction which enables a loosening of the connection between the boot heel and ski consists in that one end of the tension member is arranged so as to be fixed with respect to the ski and the other end carries a locking pin which extends transversely to the tension direction, projects beyond the tension member at both sides and can be locked in a locking groove which is constructed at the underside of the clamp, opens downward and receives the overlapping ends of the locking pin in a positive-locking manner. A modification of this principle consists in that one end of the tension member is fastened at the clamp while the other end carries a locking pin which extends transversely relative to the tension direction, projects beyond the tension member at both sides and can lock into a clamping strip which is fastened at the ski and has two locking grooves which open upward and receive the overlapping ends of the locking pin in a positive-locking manner.

The tension member per se can stretch in an elastic manner in the event that it exerts an increasing swivel resistance as the boot swivel angle increases, wherein the resistance preferably increases progressively as the stretching increases, but in most of the applications described herein the tension member is advisably not stretchable.

An advantageous construction of the invention consists in that the tension member is constructed so as not to be stretchable in the tension direction and is fastened by its end which is fixed with respect to the ski at one end of a tension spring, the other end of the tension spring being held at the ski so as to be adjustable in the tension direction. The resistance against the increasing stretching can accordingly increase progressively in a simple manner and the resistance can be adjusted by the adjustability of the spring.

Another variant is provided in that the tension member is constructed so as not to be stretchable in the tension direction and is guided between its end which is arranged so as to be fixed with respect to the ski and its free end in an S-shaped manner via two deflecting bodies. The first deflecting body which is situated closer to the end which is fixed with respect to the ski is spring-mounted by means of an adjustable pressure spring and the second deflecting body is arranged so as to be fixed with respect to the ski. The arrangement can be effected in such a way that the spring is arranged in a housing which has an outlet opening for the tension member. The rim of the outlet opening in the housing serves as a deflecting body which is fixed with respect to the ski. The resistance to pulling can also be changed in this case and the start of the highly progressive resistance phase can be adjusted.

Another possibility for lengthening the tension member in the transition from the jumping phase to the telemark landing consists in that the tension member is arranged with one of its ends directly or indirectly at the boot heel and with its other end at the ski so as to be fixed in the region of the sole support and is guided in the intermediate region around a deflecting pin which is swivelably supported at one end at a point which is fixed with respect to the ski and can be locked by its other end in a latch arranged at the ski and detached from the latter when a predetermined force is exceeded.

Another possibility for adjusting the resistance during swiveling depending on the requirements, i.e. depending on the jumping phase or landing, consists in that the tension member is constructed so as not to stretchable in the tension direction and is arranged with its end which is fixed with respect to the ski at a spring-loaded wind-on roll which is adjustable in the rotating direction.

In order to fix a defined transition in the increase of the swivel angle, the wind-on spool can be provided in another construction of the invention with a driver supported at a spring-mounted stop which is fixed with respect to the ski and which releases the driver and accordingly allows a further revolution of the wind-on spool when an adjustable tensile force at the tension member is exceeded.

A particularly advantageous construction of the aimed for solution, a defined transition in the swivel angle area from the ski jump to the landing phase, is characterized according to the invention in that the tension member is guided between the wind-on spool and the boot heel via a deflecting device which is fixed with respect to the ski, and in that a snap-in lock which is fixed with respect to the ski is provided between the wind-on spool and the deflecting device for a thickening arranged on the tension member. The snap-in lock accepts the thickening of the tension member when a predetermined tensile force is exceeded so as to lengthen the tension member. The thickening is displaceable and adjustable in the longitudinal direction of the tension member in an advantageous manner.

An advantageous construction of the snap-in lock is characterized in that the snap-in lock is constructed as a U-shaped clip fastened with its base on the ski, its legs being constructed in a resilient manner.

A constructionally advantageous solution results when the snap-in lock is provided at the deflecting device.

The invention is explained in more detail in the following with the aid of embodiment examples shown in the drawings:

DESCRIPTION OF THE PREFERRED EMBODIMENTS

Figure 1:
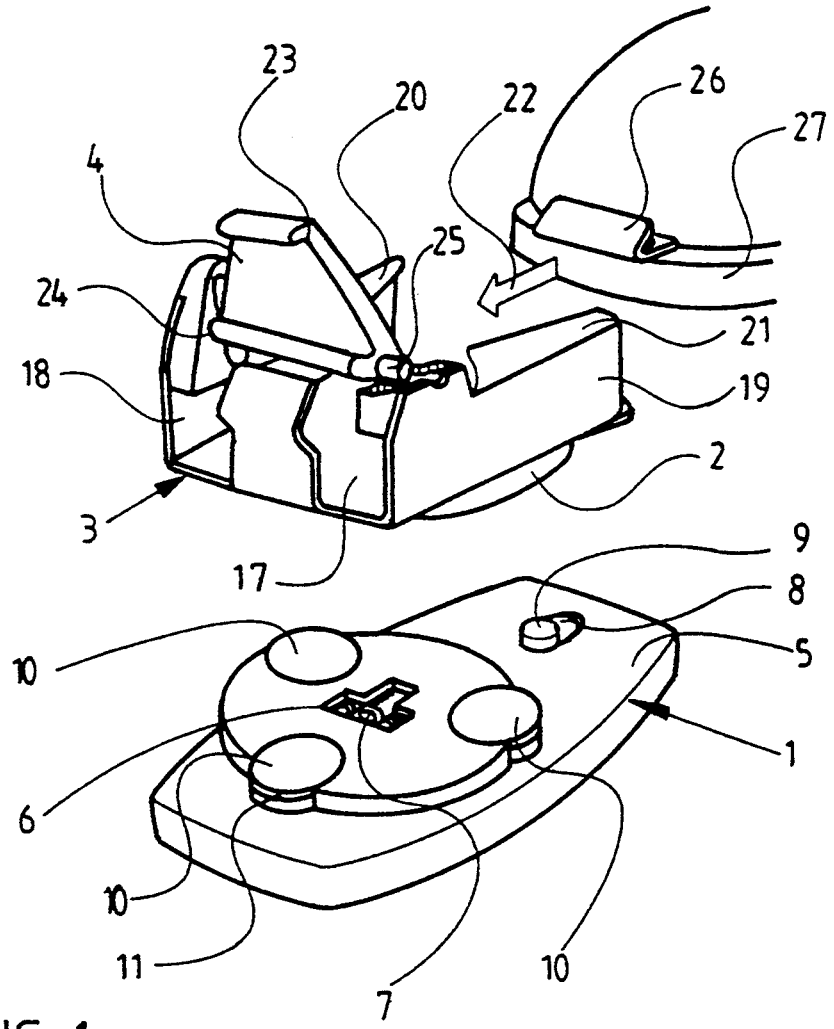
FIG. 1 is an exploded view of a front safety binding including base part, release part and guide jaw with clamping device.
Figure 2:
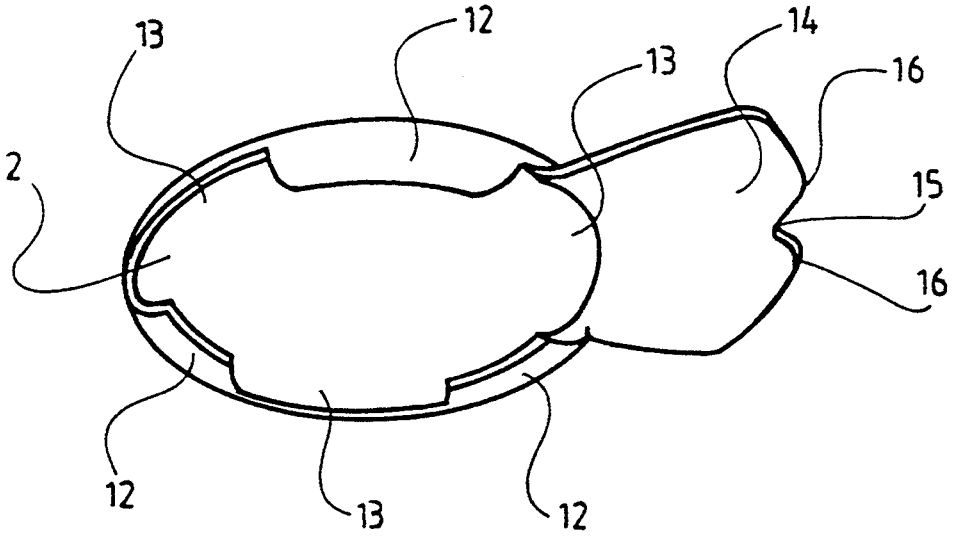
FIG. 2 shows the release part as seen from below.

FIGS. 1 and 2 show a front sole holding device as usable e.g. in connection with the heel holding device according to FIGS. 3 to 29.

As can be seen in FIGS. 1 and 2, the front safety binding includes a base part I which can be fastened to a ski, not shown, a release part 2, and a guide jaw 3 with clamping device 4, which guide jaw 3 can be fastened to the release part.

The base part 1 includes a housing 5 in which is accommodated a release mechanism including a spring package having a plurality of springs 6 which are supported on the one hand against a stop, not shown in the drawing, which is adjustable by a screw 7 and on the other hand against a movable slide, likewise not shown in the drawing, which carries a control roll 9 projecting out through a slot 8 in the housing 5. Further, three guide rolls 10 are supported on the housing 5 so as to be freely rotatable and are provided with circumferential grooves 11. The guide rolls are arranged at equidistant intervals with their rotational axes, not shown, on a circle and serve to support the release part 2 in a rotatable manner. This release part 2 has at its circumference a number of downwardly and inwardly bent guide flanges 12 corresponding to the number of guide rolls 10. A number of recesses 13 which likewise corresponds to the number of guide rolls are defined between the guide flanges 12. The guide flanges 12 engage in the circumferential grooves 11 with their inwardly bent edges so that the release part 2 is rotatably supported by the guide rolls 10. The arrangement of the guide flanges 12 is effected in such a way that the guide rolls 10 lie in the center of the respective guide flanges 12 in the operating position. When the release part 2 is rotated by an amount corresponding to half the circumferential path of the respective guide flanges 12, these guide flanges 12 exit from the circumferential grooves and the guide rolls arrive in the region of the recesses 13 so that the release part 2 is released from the guide rolls 10 and accordingly freed from the base part 1.

A release cam 14 having a central locking recess 15 at its free end and symmetrically constructed control cams 16 adjoining the latter is securely connected with the release part 2. In the operating position, the control roll 9 engages in the locking recess 15. The control cams 16 adjoining the locking recess 15 first cause a resistance against a rotation of the release part 2 due to their shape. Since the control roll 9 lies in the locking recess 15 in the operating position, a rotation of the release part 2 is only possible when the control roll 9 which rolls at one of the control cams 16 during the rotating movement is displaced in its elongated hole 8 against the resistance of the springs 6. The release rigidity can accordingly be fixed depending on the adjustment of the adjustable stop.

The guide jaw 3 provided on the release part 2 is substantially U-shaped and has a base 17 as well as two vertically upright sides 18 and 19 whose free edges 20 and 21 are bent inward and are situated at a distance from the base 17 substantially corresponding to the thickness of the boot sole so that the latter, after insertion in the direction of the arrow 22, is held in the lateral direction by the sides 18, 19 as well as at the top by the edges 20, 21. The clamping device 4 which is constructed as an angled two-armed lever 23, 24 and is swivelably supported in the sides 18, 19 by means of an insertable shaft 25 is provided so that the boot cannot slip out toward the rear, that is, opposite the direction of the arrow 22. When inserting the boot into the guide jaw, the clamping device 4 is first swiveled in such a way that the lever 23 faces forward and downward so that a V-shaped mounting 26 which is open toward the rear can slide on the upper side of the boot sole 27 under the short lever 24. The lever 24 hooks securely into the mounting 26 when the clamping device 4 is swiveled up.

Various embodiment forms of a heel holding device are described in the following which can be used in combination with a front sole holding device according to FIGS. 1 and 2, but also with a non-releasing heel holding device, as used for years in ski jumping, and including a front jaw with circumferential cable binding.

Figure 3:
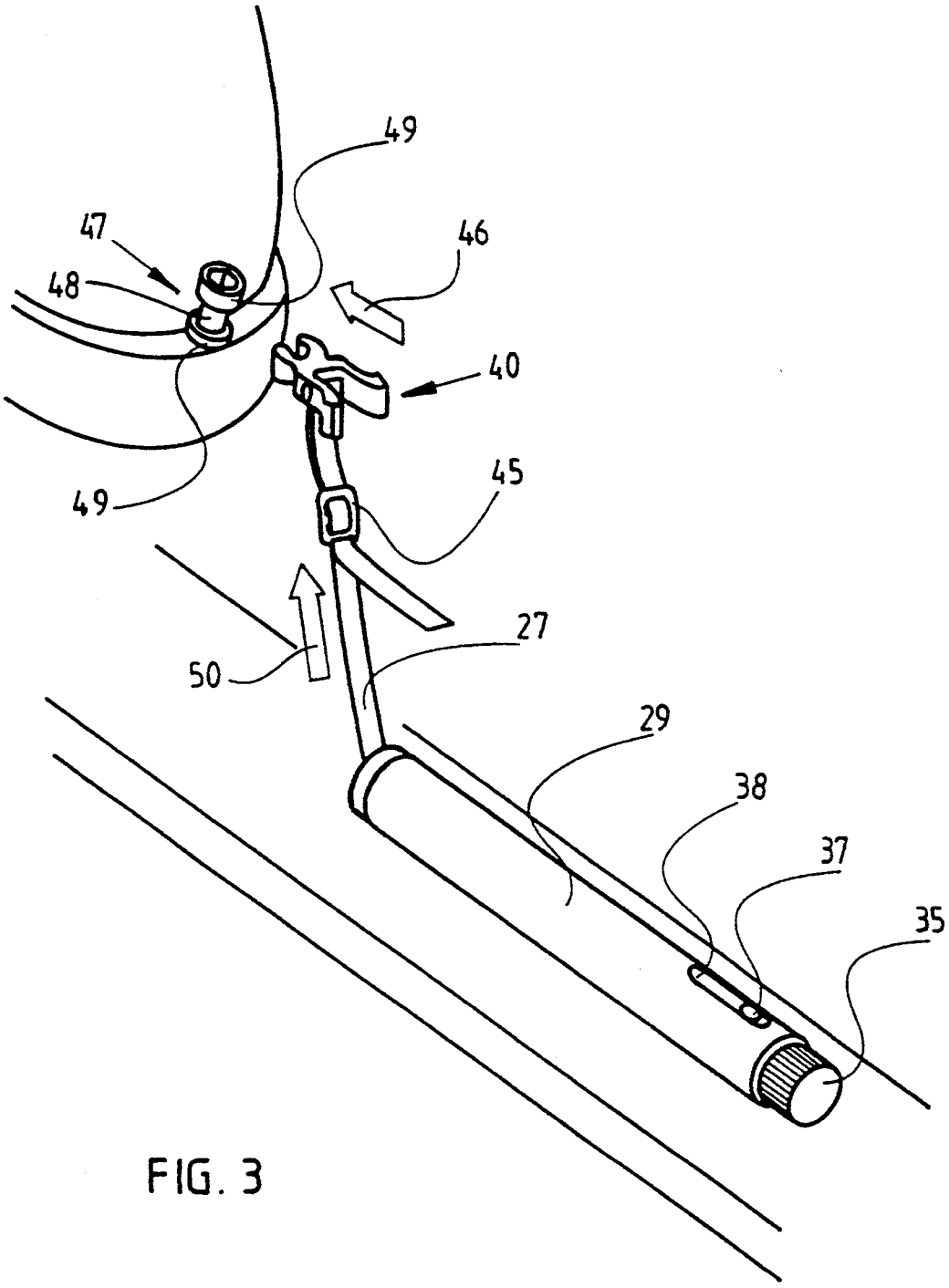
FIG. 3 shows a view of a heel holding device.
Figure 4:
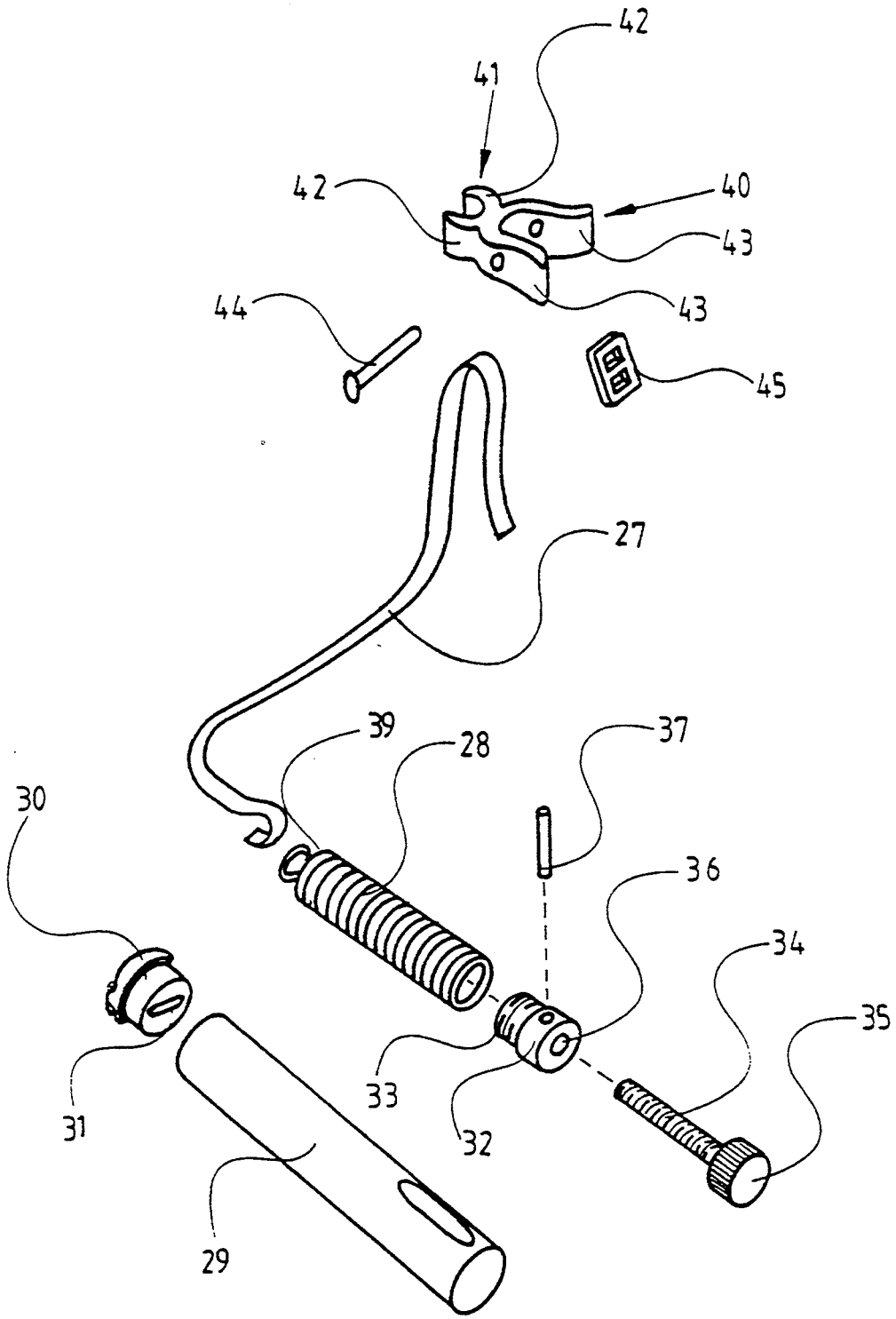
FIG. 4 is an exploded view of the heel holding device according to FIG. 3.
Figure 10:
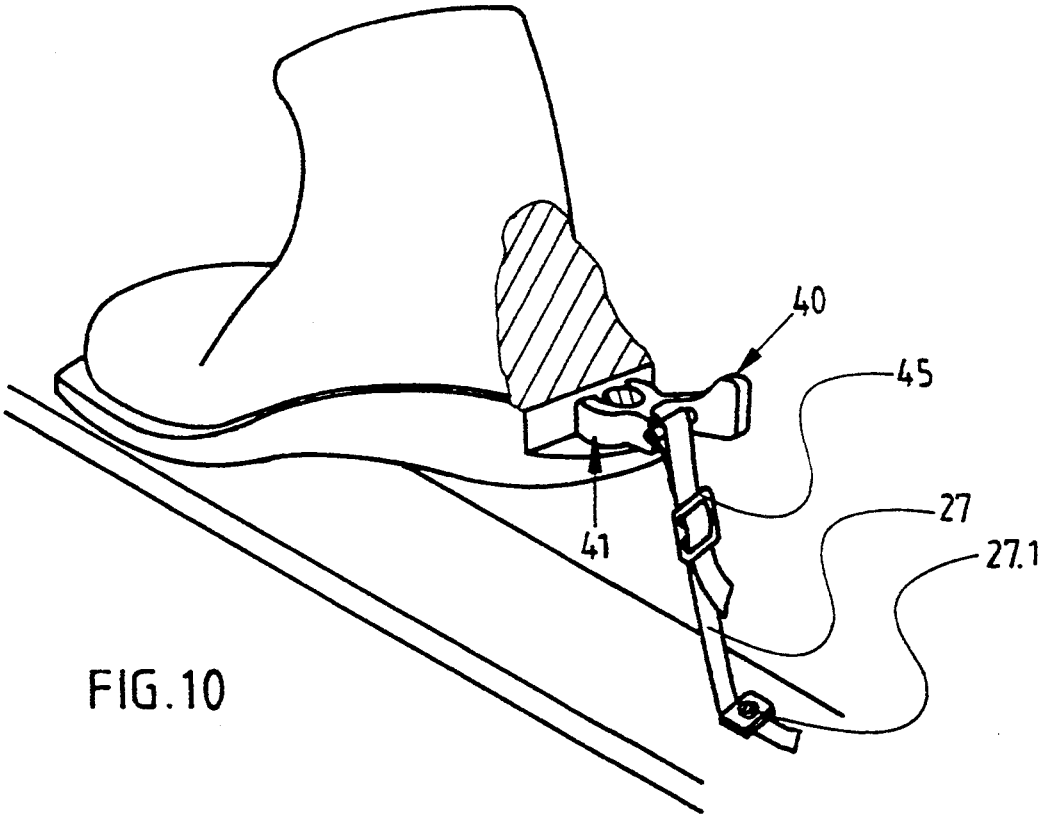
FIG. 10 is a partially broken off view according to FIG. 9.
Figure 11:
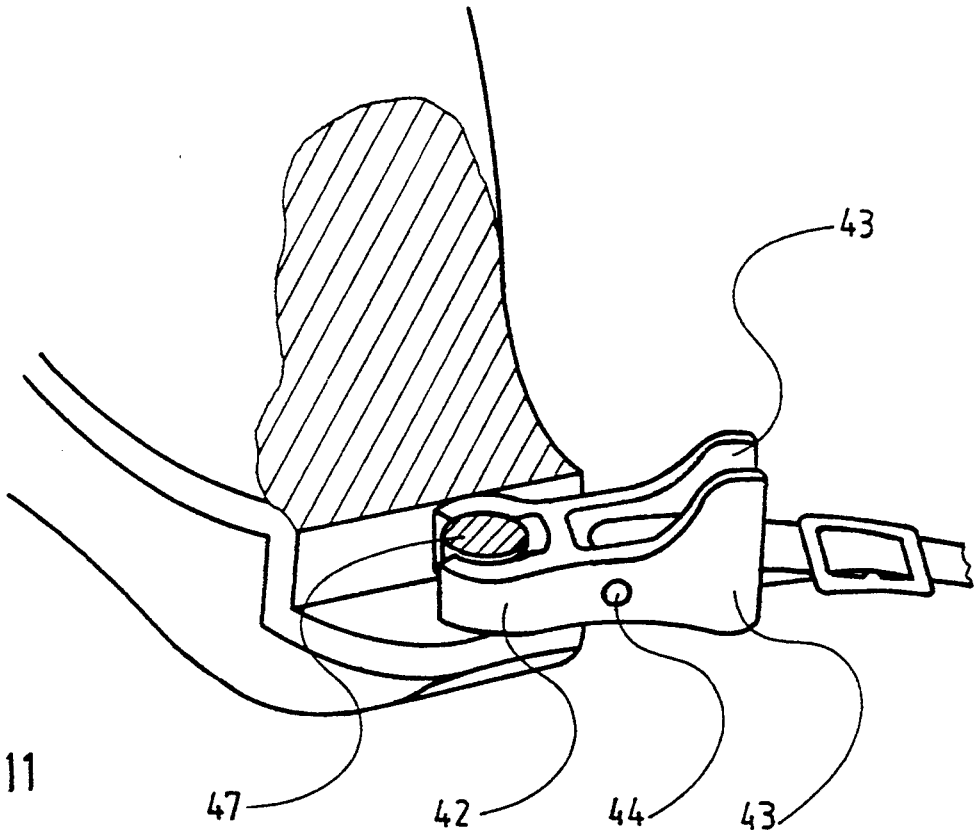
FIG. 11 is a view corresponding to FIG. 10 with a swiveled part of the heel holding device in the releasing process.

The heel holding device shown in FIGS. 3 and 4 includes a non-stretchable tension member 27 in the form of a ribbon which is movable in every direction and fastened by one end at a tension spring 28 which is guided in a tube 29 fixed to the surface of the ski. This tube is located behind the boot heel on the surface of the ski and has, at its end facing the boot, a guide body 30 in the form of a plug fastened in the tube 29. This guide body 30 has a transverse slot 31 through which the tension member 27 passes. The end of the spring 28 remote of the tension member 27 is fastened at an adjustable stop 32 which is displaceably guided in the tube 29 and has a threaded part 33 for screwing into the spring 28. To adjust the stop 32 a screw bolt 34 with a head 35 contacting the end of the tube 29 is screwed into an internal thread 36 of the stop 32. This stop 32 has a pin 37 which engages through an elongated hole 38 in the tube 39 to show the position of the stop 32. The stretching path of the spring 28, and accordingly the pull-out path of the tension member 27, is defined by the contact of the front end 39 of the tension spring 28 at the guide body 30 so as to meet the need for a fixed stop for the swiveling movement of the boot heel. The stretching path of the spring 28 can be changed by displacing the stop 32. The pull-out resistance can accordingly be adjusted. The other end of the tension member 27 is fastened at a clamp 40 which is constructed in the manner of pincers and has a head 41 having two grippers 42. Two legs 43 through which a pin 44 is inserted are constructed so as to form one piece with the head 41. The pin 44 bridges the intermediate space between the two legs 43 and serves to fix the tension member 27, whose end is looped around this pin and fixed so as to be adjustable by a buckle 45 in order to adjust the pull-out path. The clamp 40 can be attached to a peg 47 in the direction of the arrow 46. The peg 47 is fastened to the heel so as to be substantially vertical to the surface of the sole of the boot and has a cylindrical center part 48 as well as two limiting flanges 49. The distance between the flanges 49 corresponds to the thickness of the head 41 of the clamp 40 which is produced from a resilient plastic and can be clipped onto the cylindrical part 48 of the peg 47 with its gripper arms 42 so that this clamp can be detached from the peg again against a certain resistance. Since the clamp fits in exactly between the two flanges 49, a tilting of this clamp is impossible. Thus, it can only be slid onto and pulled off the peg vertically relative to the axis of the peg. Accordingly, the clamp cannot be detached from the peg 47 when the boot heel is lifted so that the tension member 27 is pulled out of the tube 29 against the action of the spring 28 when the boot heel is lifted. If the boot frees itself from the safety binding by the application of torque and the ski gets caught in the snow, a pulling action occurs substantially parallel to the boot sole in contrast to the swiveling movement in which the tension member 27 is pulled in the direction of the arrow 50 which is at an angle of approximately 90° to the surface of the ski, so that the clamp is subjected to a tensile loading in the opposite direction of arrow 46 and can accordingly free itself from the peg 47. Since the gripper arm 42 is adapted to the shape of the cylindrical part 48 of the peg 47, it is possible for the clamp 40 to turn around the peg axis as shown in FIG. 11. The lateral swiveling out movement of the boot in a releasing process of the front safety binding is accordingly not impaired. The construction shown in FIGS. 9 to 11 diverges from that according to FIG. 3 only in that the peg 47 is arranged in a cut out portion 51 in the boot heel rather than on the upper side of the projecting edge of the heel, resulting in a more attractive arrangement of the peg 47. The peg 47 is held in the upper and lower defining wall 51.1 and 51.2 at a certain distance from the vertical defining wall 51.3. The distance of the defining walls 51.1 and 51.2 extending parallel to the surface of the sole corresponds to the thickness of the head 41 of the clamp 40, so that these defining walls take over the function of the flanges 49 in the embodiment form according to FIG. 3 and prevent a tilting of the clamp 40 relative to the peg 47. FIG. 10 shows the use of a tension member 27 which is movable in every direction, but is not stretchable. The tension member 27 is fastened at the ski by a screw 27,1 and serves only to define the lift of the boot heel. The magnitude of the swivel angle of the boot sole relative to the ski is adjustable by changing the length of the tension member 27 by means of the buckle 45.

Two additional embodiment forms for the construction of the heel holding device are shown in FIGS. 5 to 8 which are concerned with the construction of the part at which the end of the tension member 27 which is fixed with respect to the ski is fastened and which serves to generate resistance when the tension member 27 is pulled out.

Figure 5:
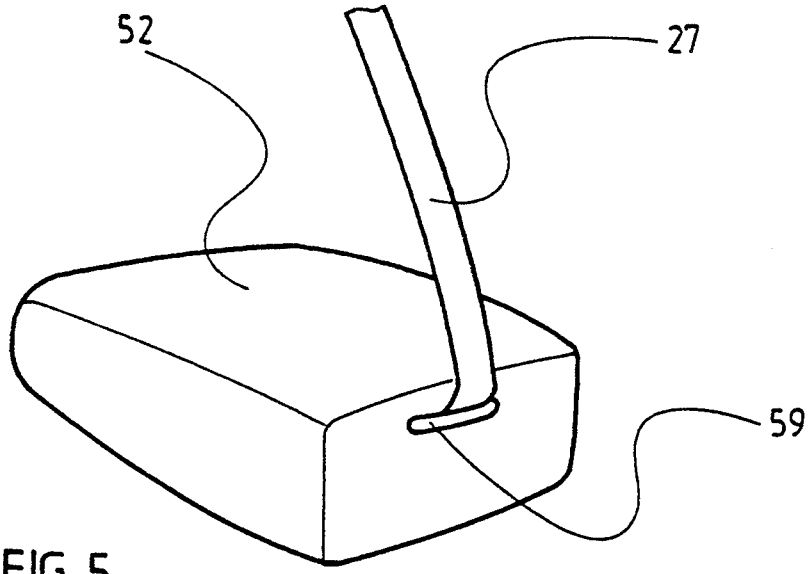
FIG. 5 shows a part of another embodiment form of the heel holding device.
Figure 6:
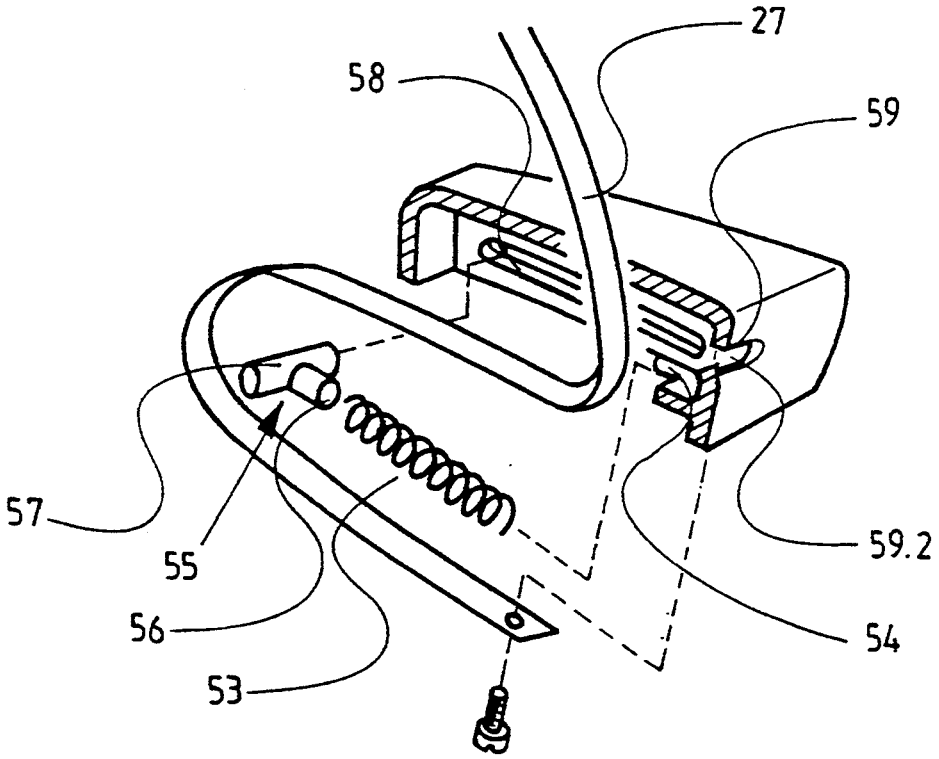
FIG. 6 is an exploded view of the heel holding device according to FIG. 5 in longitudinal section.

In the embodiment form according to FIGS. 5 and 6, a pressure spring 53 is arranged in a housing 52 which is fixed with respect to the ski. The pressure spring 53 is attached at one end to a post 54 in the housing 52 and has a T-shaped deflecting body 55 at its other end, the longitudinal bar 56 of the deflecting body 55 being inserted in the spring 53 and its transverse bar 57 being guided in lateral longitudinal slots 58 of the housing 52. The end of the tension member 27 which is fixed with respect to the ski is fastened at the housing 52 and ski, respectively, by a screw and is guided in an S-shaped manner via the deflecting body 57 on one side and via another deflecting body 59 on the other side, which latter is formed by the boundary of a slot 59.2 in the housing 52. The free end of the tension member 27 is fastened at the ski boot in the same manner shown in FIGS. 3 and 9 to 11 and is therefore not shown in more detail in these drawings. When a tensile force acts on the tension member 27, the latter is pulled out of the housing 52 and the tension member presses against the deflecting body 57 during this movement and displaces it against the action of the spring 53. The displacing path can be limited by the slot 58 so that the lifting of the boot heel is effected accompanied by increasing resistance until reaching a fixed stop.

Figure 7:
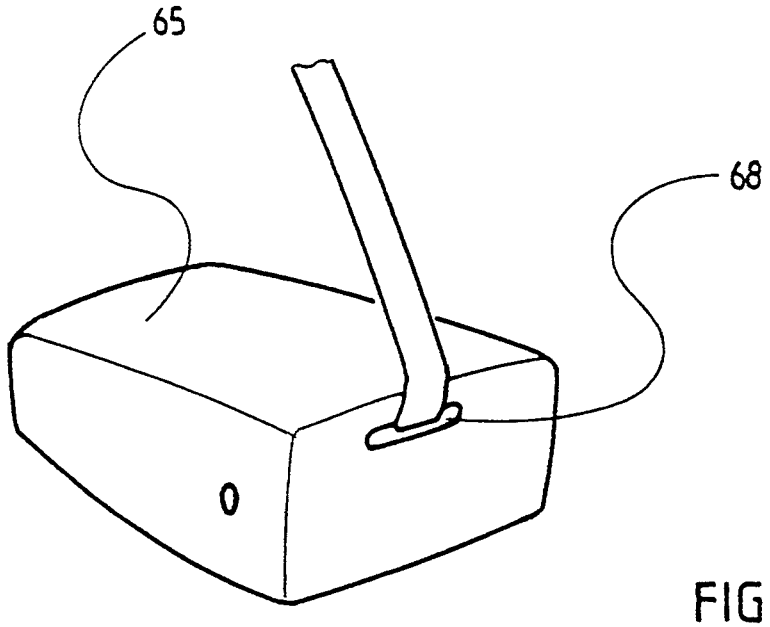
FIG. 7 is an external view of a part of another construction of a heel holding device.
Figure 8:
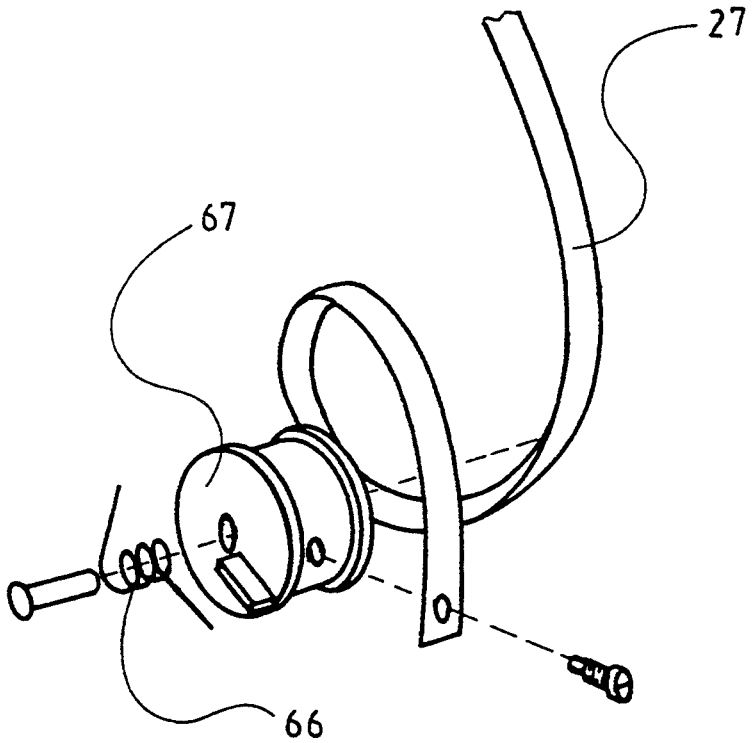
FIG. 8 shows a wind-on mechanism for the heel holding device according to FIG. 7.
Figure 9:
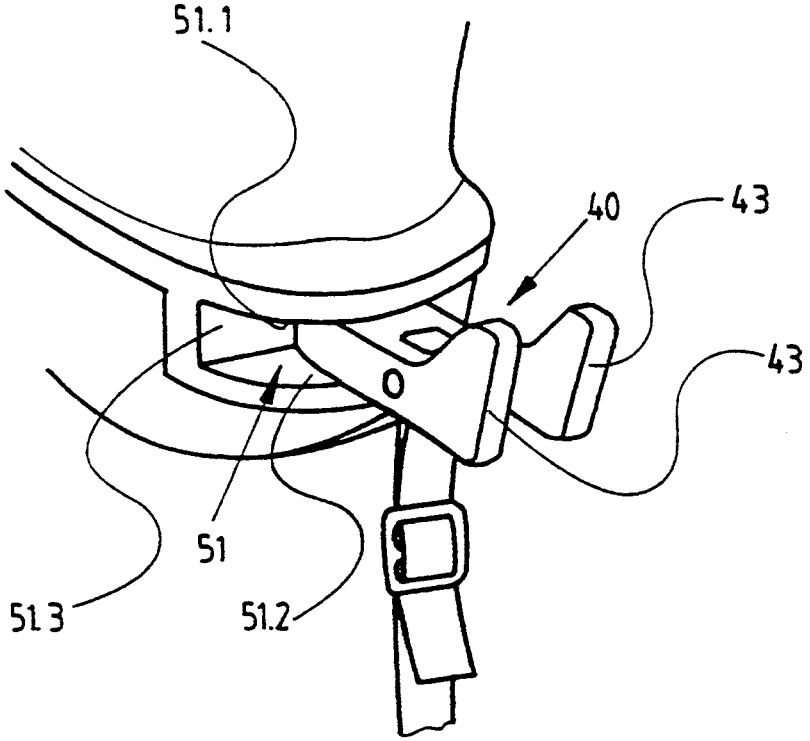
FIG. 9 is a view of a boot heel with a part of a heel holding device.

FIGS. 7 and 8 show another embodiment form of the heel holding device. This includes a wind-on spool 67 arranged in a housing 65. The wind-on spool 67 is loaded by a spring 66 and continuously strives to pull the tension member 27 through a slot 68 into the housing 65. The tension member 27 is wound up onto the wind-on spool 67, from which it is unwound when the boot heel is raised against the action of the spring 66.

Figure 12:
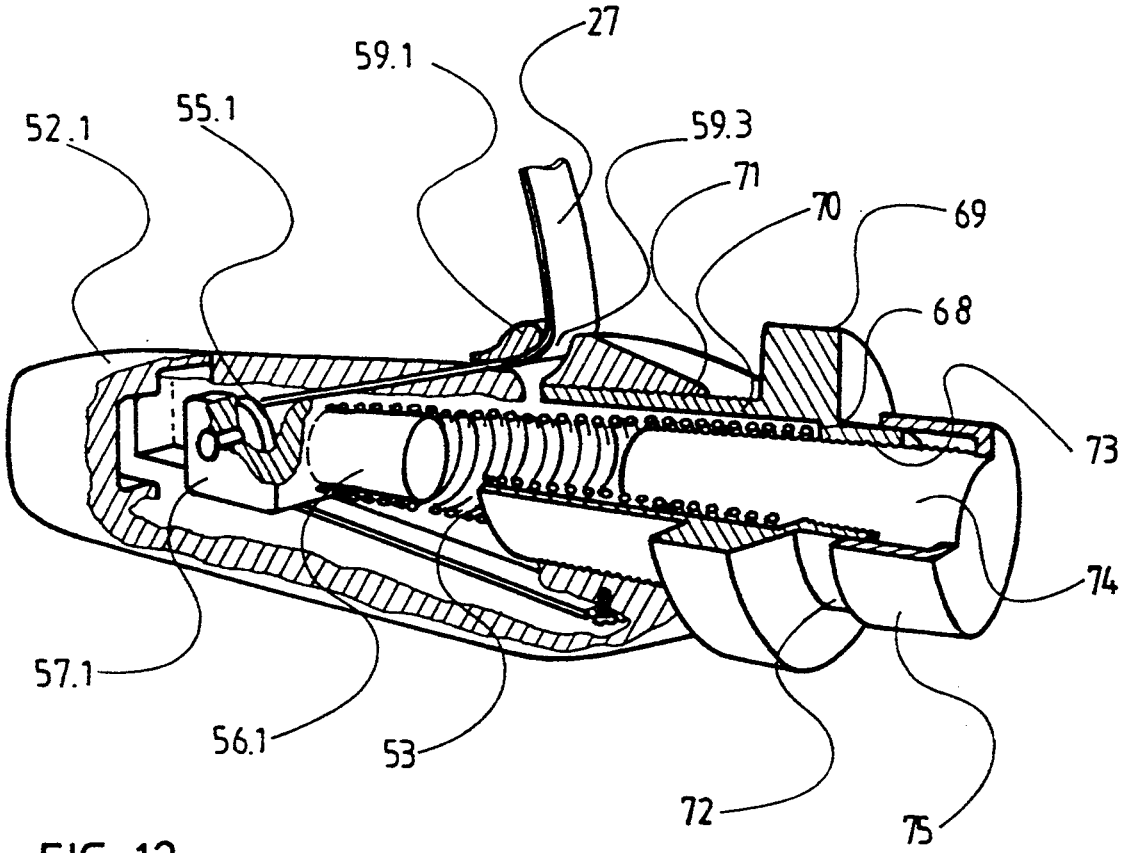
FIG. 12 is a partial section through another construction of a heel holding device.

FIG. 12 shows a construction of the heel holding device which is modified relative to FIGS. 5 and 6. The tension member 27 is fastened by one end at the housing in a housing 52.1 which is fixed with respect to the ski and is guided in an S-shaped manner via two deflecting bodies 55.1 and 59.1. The deflecting body 58.1 is the upper boundary of a slot 59.3 from which the tension member 27 is guided out of the housing. The deflecting body 55.1 is constructed as a rotatably supported roller which is rotatably supported in a fork head 57.1, the latter being guided in the housing so as to slide in the longitudinal direction of the ski. The fork head 57.1 has a cylindrical projection 56.1 which extends in the longitudinal direction of the housing and accordingly in the longitudinal direction of the ski, a pressure spring 53 being attached to the projection 56.1. The other end of the pressure spring is supported at an inner flange 68 of a hollow screw 70 which is constructed with an outer flange 69 and which can be screwed into a threaded bore hole 71 of the housing 52.1. Together with its inner flange 68, this hollow screw 70 forms an adjustable stop for the spring 53. The hollow screw 70 has a hollow-cylindrical protuberance 72 which projects out from the outer flange 69 and is provided with an internal thread 73 in which a screw bolt 74 can be screwed and which engages in the interior of the spring 53. The screw bolt 74 is provided at its outer end with a turning knob 75 of hollow construction which engages over the protuberance 72. The turning knob 75 serves for adjusting the screw bolt 74 whose end situated inside the housing 52.1 serves as a stop for the projection 56.1, so that a changeable stop is provided for defining the pull-out path of the tension member 27 depending on the depth to which the screw bolt 74 can be screwed in.

The constructions of heel holding devices shown in FIGS. 13 to 29 take into account the different requirements demanded of such a heel holding device during the ski jump and during landing to a greater degree than in the previously described embodiment forms.

In these embodiment forms a clamp is used for fastening the tension member at the boot heel as was described in its fundamental construction in connection with FIGS. 3 and 4.

Figure 13:
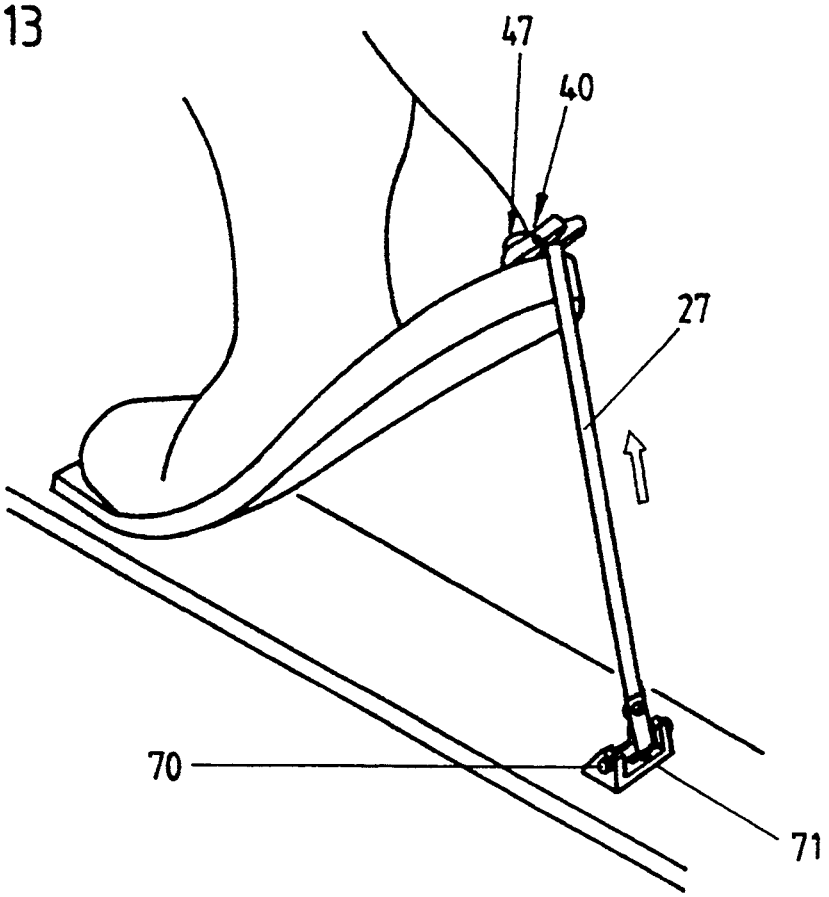
FIG. 13 is a view of another construction of a heel holding device.
Figure 14:
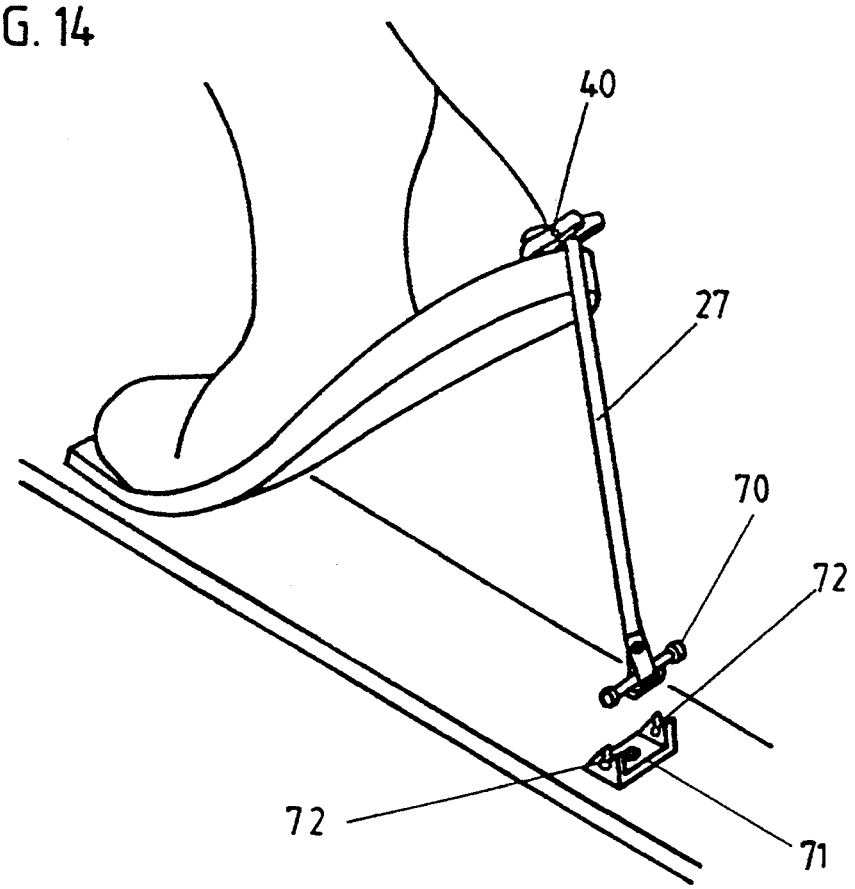
FIG. 14 is a heel holding device according to FIG. 13 in the disconnected state.

The embodiment form shown in FIGS. 13 and 14 includes a non-stretchable tension member 27 in the form of a ribbon which is movable in every direction. A clamp 40 for fastening at a peg 47 at the boot heel is provided at one end of the tension member 27, while the other end of the tension member 27 carries a locking pin 70 which projects beyond the tension member at both sides and can be locked in a clamping strip 71 which is fastened at the ski and has two locking grooves 72 which open upward and receive the projecting ends of the locking pin in a positive-locking manner. During the ski jump the locking pin 70 is in the locked-in position shown in FIG. 13 and the tension member 27 limits the swivel angle between the boot sole and ski to the degree required during the ski jump. When landing in telemark style in which the ski jumper's leg is substantially more bent and the boot heel is lifted higher, the locking pin 70 is pulled out of the locking grooves 72 in which it is held by a clamping action due to the increased tensile force. The clamping strip 71 is preferably produced from a resiliently deformable plastic to enable this process.

Figure 15:
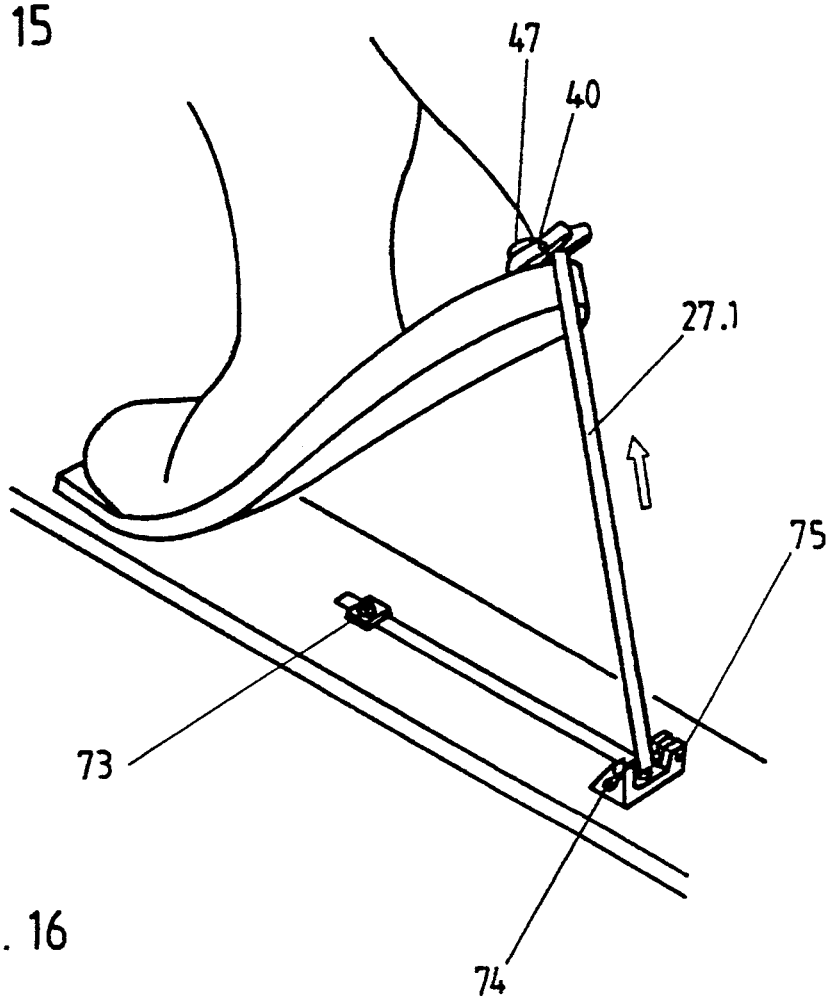
FIG. 15 shows a view of an extendable heel holding device.
Figure 16:
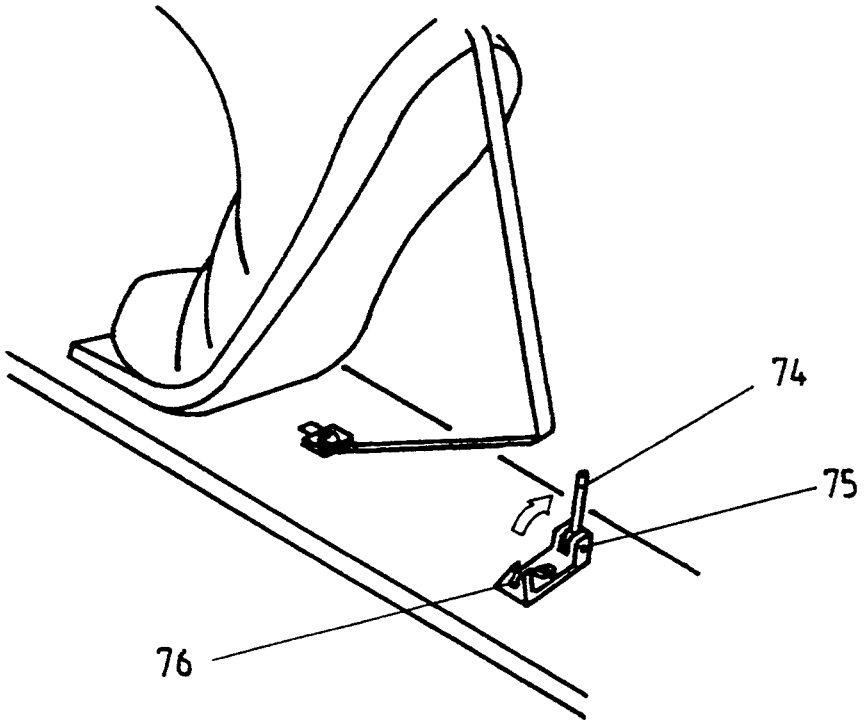
FIG. 16 shows the heel holding device according to FIG. 15 in the disconnected state.

In the construction according to FIGS. 15 and 16, a longer tension member 27.1 is provided, whose end is again fastened at the peg 47 as in the construction according to FIG. 13 by means of the clamp 40, while the other end of the tension member 27.1 is fastened at the ski by means of a screw 73 in the region of the sole support. The region of the tension member 73 located between the ends is guided around a deflecting pin 74 which is swivelably supported by one end at a point 75 which is fixed with respect to the ski and can be locked in a latch 76 arranged at the ski by its other end and can be detached from this when a predetermined force is exceeded as shown in FIG. 16. This makes it possible to swivel the boot heel up farther relative to the guidance of the tension member according to FIG. 15 for telemark landing.

Figure 17:
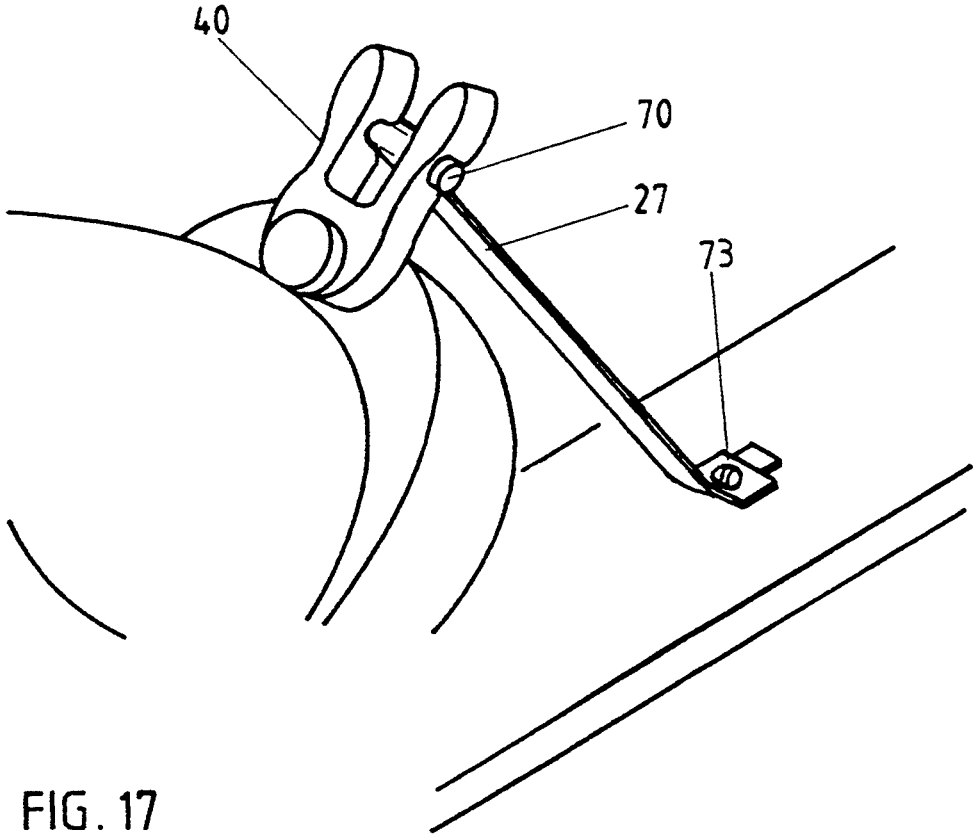
FIG. 17 shows another construction of the heel holding device.
Figure 18:
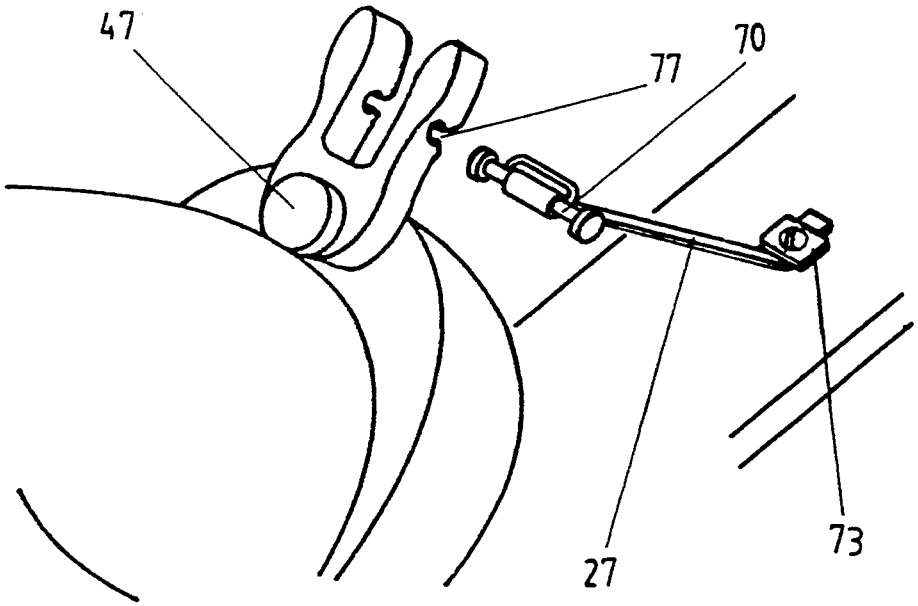
FIG. 18 shows the heel holding device according to FIG. 17 in the disconnected state.

The construction according to FIGS. 17 and 18 corresponds fundamentally with respect to principle to the construction according to FIGS. 13 and 14. A locking pin 70 is also provided here and overlaps the tension member 27 on both sides. This locking pin can be locked in a locking groove 77 which opens downward, receives the projecting ends of the locking pin 70 in a positive-locking manner and is constructed at the underside of the clamp 40. The other end of the tension member 27 is fastened to the ski by a screw 73.

Figure 19:
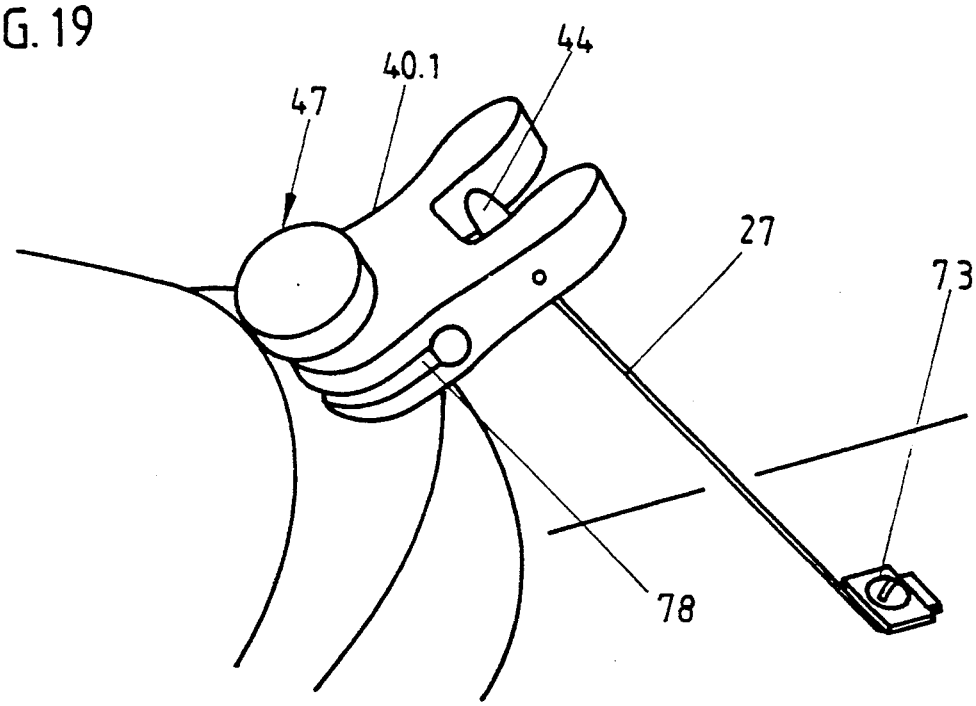
FIG. 19 shows another construction of the heel holding device.
Figure 20:
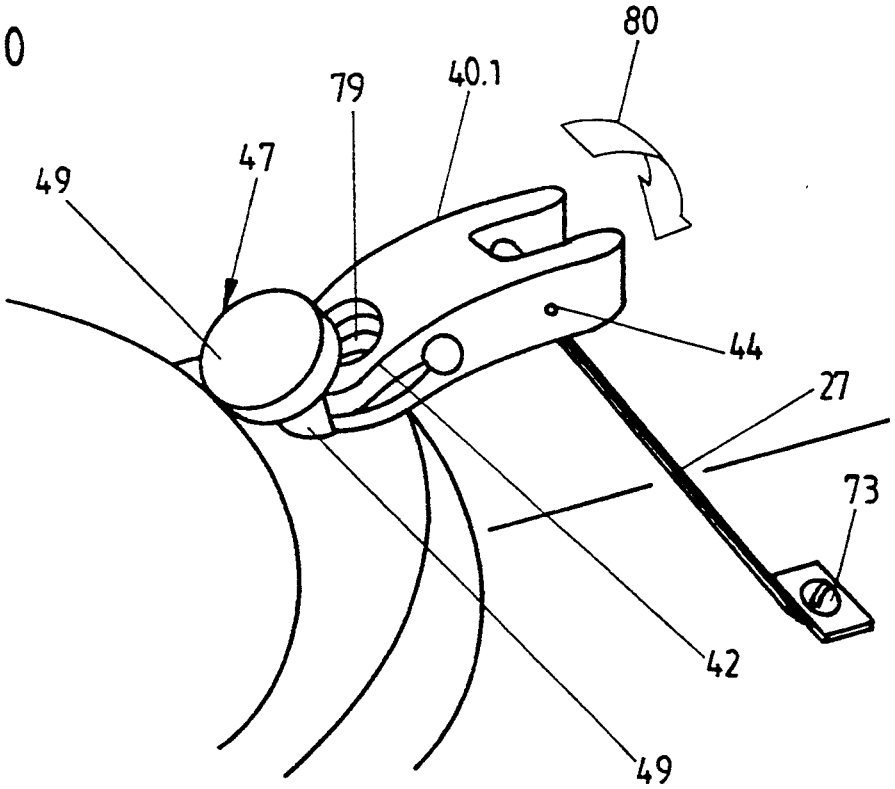
FIG. 20 shows the heel holding device according to FIG. 19 in the disconnected state.

In the embodiment form according to FIGS. 19 and 20 the end of the tension member 27 is fastened to the ski by a screw 73, while the other end is fastened to the clamp 40.1 by means of a pin 44 as shown in FIG. 4. In order that the clamp can enable the boot heel to be released during the landing process in spite of the fixed connection of the tension member 27 to the ski and the clamp, the clamp is provided with a gap 78 which extends from the end which can be attached to the peg 47 beyond the recess 79 provided for the peg, the recess 79 being constructed between the grippers 42 of the clamp 40.1 and serving to receive the peg 47. Because of this gap 78, the part of the clamp cooperating with the peg 47 can be deformed, as seen in FIG. 20, so that the clamp no longer fills up the entire region between the flanges 49 of the peg 47 and can accordingly be pulled off the peg 47 in the direction of the arrow 80, which is impossible when the clamps 40 are constructed from solid material. FIG. 19 shows the position of the tension member and the clamp during the jumping phase, while FIG. 20 shows the state of this clamp at the moment when it is detached.

Figure 21:
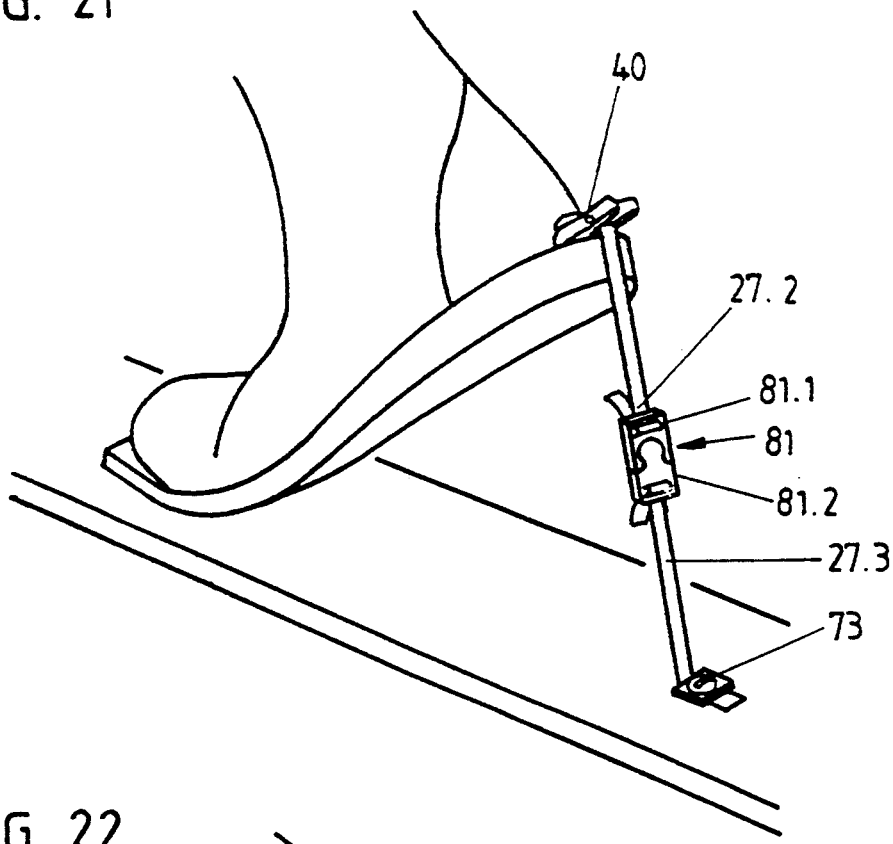
FIG. 21 shows another embodiment form of a heel holding device.
Figure 22:
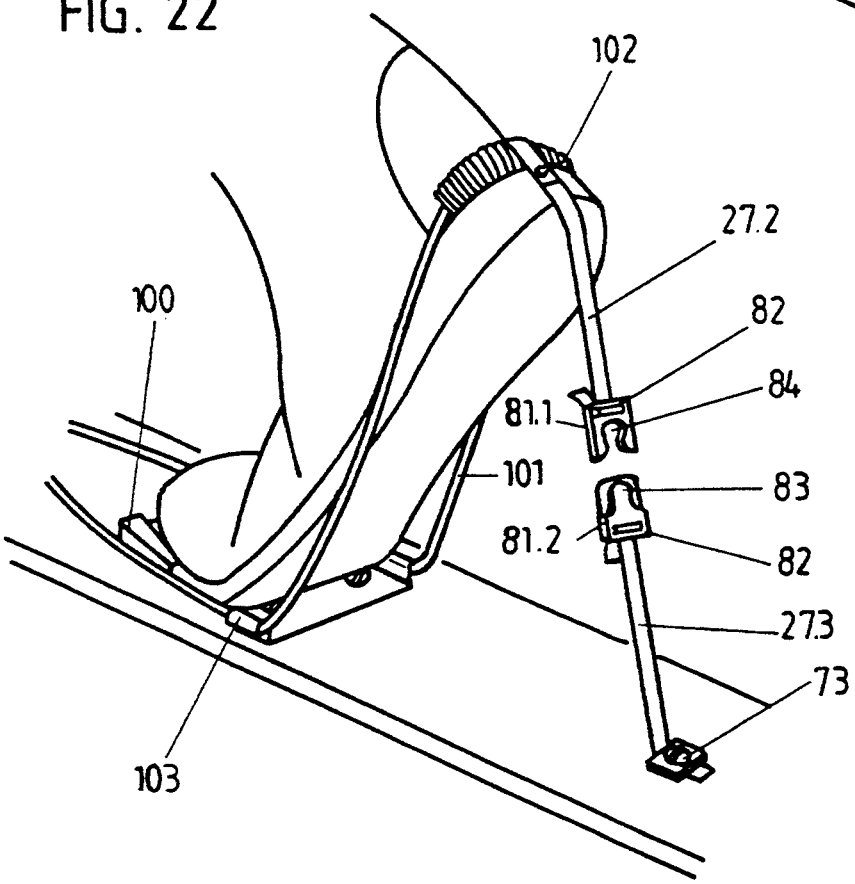
FIG. 22 shows the heel holding device according to FIG. 21 in disconnected form in connection with a variant of the ski binding.

In the embodiment form according to FIGS. 21 and 22, the tension member is constructed in two parts, designated by 27.2 and 27.3. The two parts are connected with one another by a two-part connecting piece 81 which is constructed in the manner of a push button. The two parts of the connecting piece are designated by 81.1 and 81.2. Both parts are provided with eyelets 82, through which the ends of the parts 27.2 and 27.3 of the tension member can be fastened so as to be adjustable. The part 81.2 has a thickened head 83 which can be locked into a corresponding locking recess 84 of the part 81.1. Since the two parts are produced from a resilient plastic, the head 83 can be pulled out of the locking recess 84 when acted upon by increased tensile force as shown in FIG. 22. This detaching process occurs in the transition from the jumping phase shown in FIG. 21 with respect to the arrangement of the tension member at the beginning of the landing in which the boot heel is swiveled up farther. One end of the tension member is fastened to the ski by a screw 73, while the other end is fastened to the clamp 40 as was described in connection with FIGS. 19 and 20. FIG. 22 shows the same heel holding device as in FIG. 21, but in the opened state and with a modification of the ski binding. While the previously described heel holding devices are combined with a safety release binding according to FIGS. 1 and 2, the combination of the heel holding device according to the invention with a formerly conventional spring binding is shown in FIG. 22. A non-release front jaw 100 is provided here, at which a cable binding including a cable 101 with a spring 102 contacting the heel is guided to a conventional tightener, not shown. The known deep-draw hooks for the cable 101 provided at both sides are designated by 103.

Figure 23:
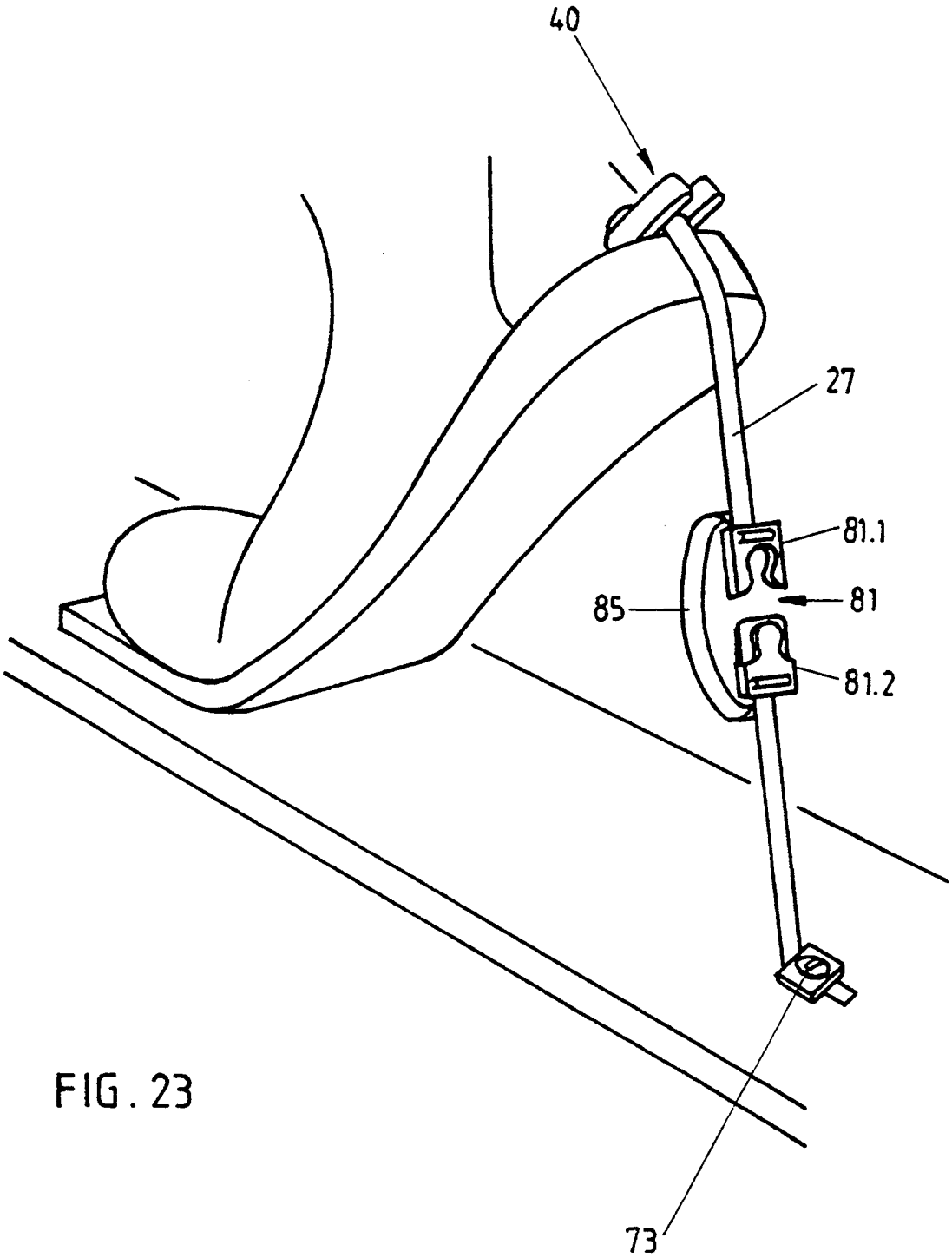
FIG. 23 shows a modification of the heel holding device according to FIG. 21.

In the construction according to FIG. 23, the tension member 27 is fastened at the ski and at the boot heel in the same manner as in the construction according to FIGS. 21 and 22. The only difference in relation to this previously described construction consists in that the tension member is constructed in one part and the two parts 81.1 and 81.2 of the connecting piece 81 are fastened at a distance from one another on the tension member so that a loop 85 remains in the closed state of the connecting piece 81. The tension member is lengthened by the length of this loop when the connecting piece 81 is loosened so that it is possible to lift the boot heel higher when landing.

Figure 24:
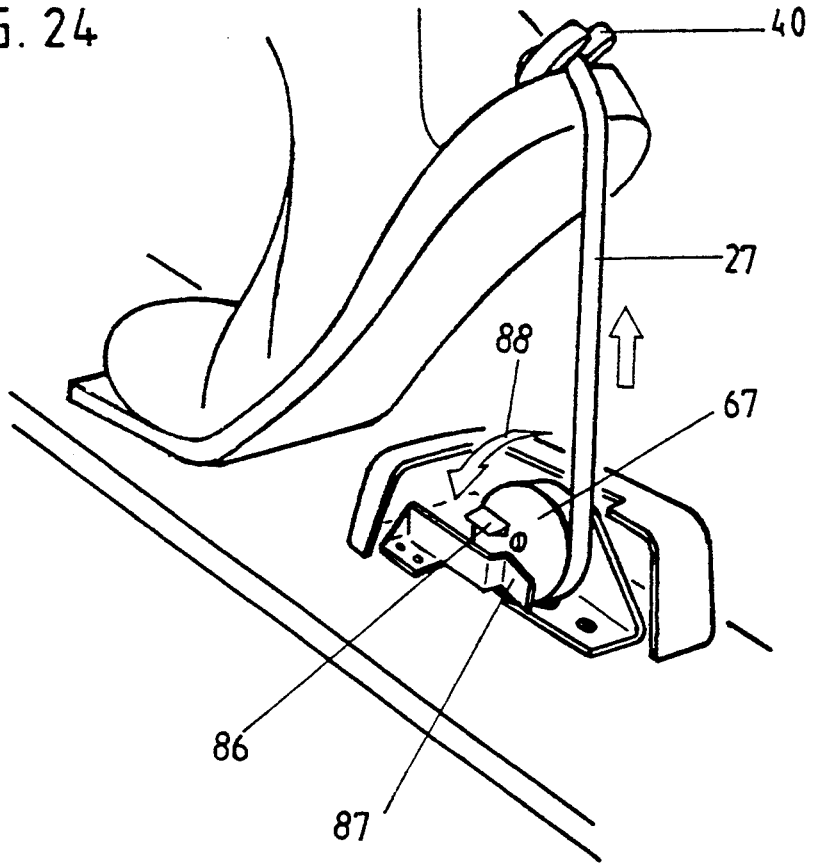
FIGS. 24 and 25 show another embodiment form of a heel holding device in different operating states.
Figure 25:
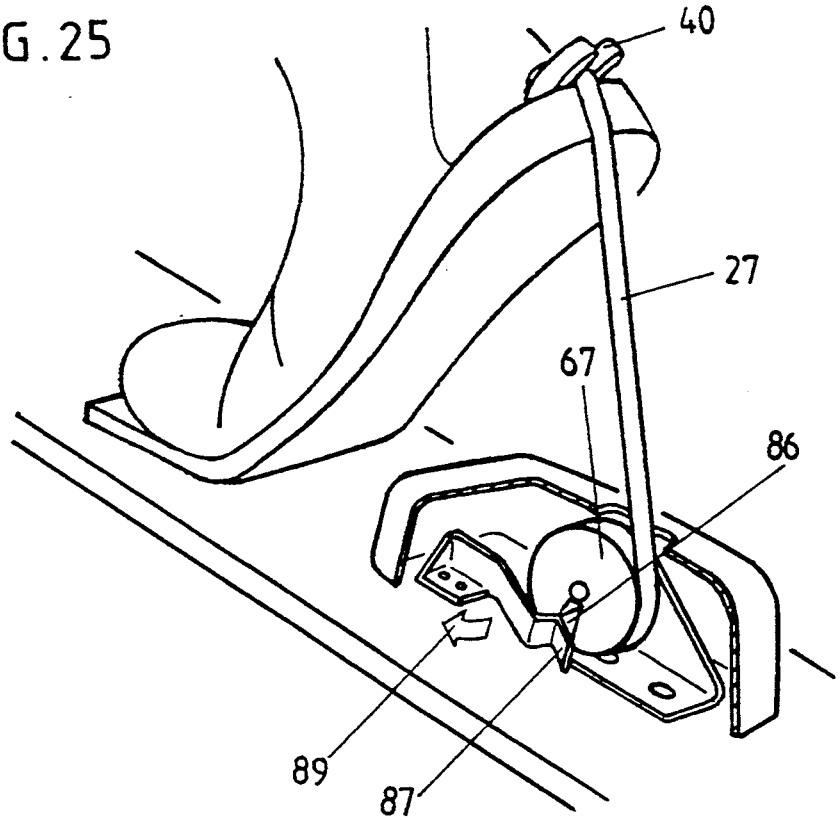

In the construction according to FIGS. 24 and 25, one end of the tension member 27 is fastened at the boot heel by the clamp 40 as in the preceding embodiment forms, while the other end of the tension member 27 is wound on a wind-on spool 67 as is shown e.g. in FIG. 8 and described in connection with this. The additional step used in the embodiment form according to FIGS. 24 and 25 in contrast to the construction according to FIGS. 7 and 8 serves to make possible a lengthening of the tension member 27 during the transition from the jumping phase to landing, specifically beyond a rigidly defined swivel angle. This rigidly defined swivel angle which is adjustable for the jumping phase is ensured by a driver 86 provided at the wind-on spool 67 and by a spring-mounted stop 87 which is fixed with respect to the ski. The driver 86 contacts the stop 87 when the wind-on spool 67 rotates in the direction of arrow 88 as shown in FIG. 24. If an additional increased tensile force occurs after the driver 88 has contacted the stop 87, as happens when landing, the stop 87 is swiveled out laterally in the direction of arrow 89, so that the wind-on spool can execute another revolution and can release an additional piece of the tension member 27 corresponding to the capacity of the wind-on spool, so that the swivel angle for the boot heel increases.

Figure 26:
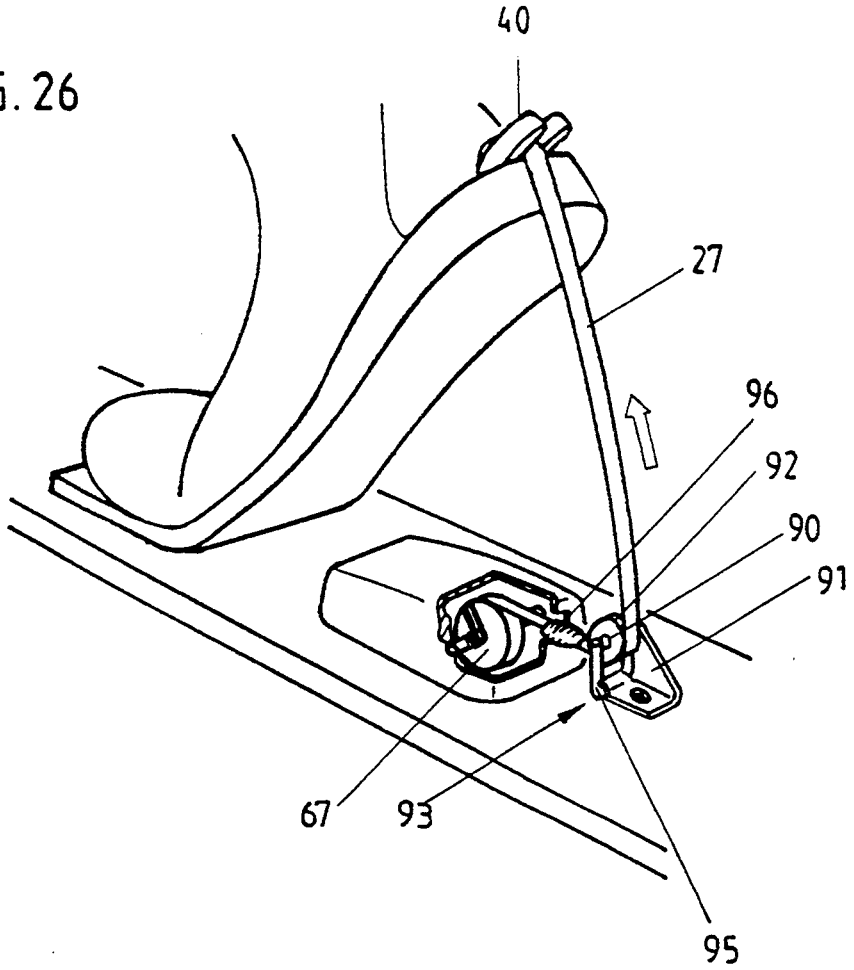
FIGS. 26 and 27 show another embodiment form of a heel holding device in different operating states.
Figure 27:
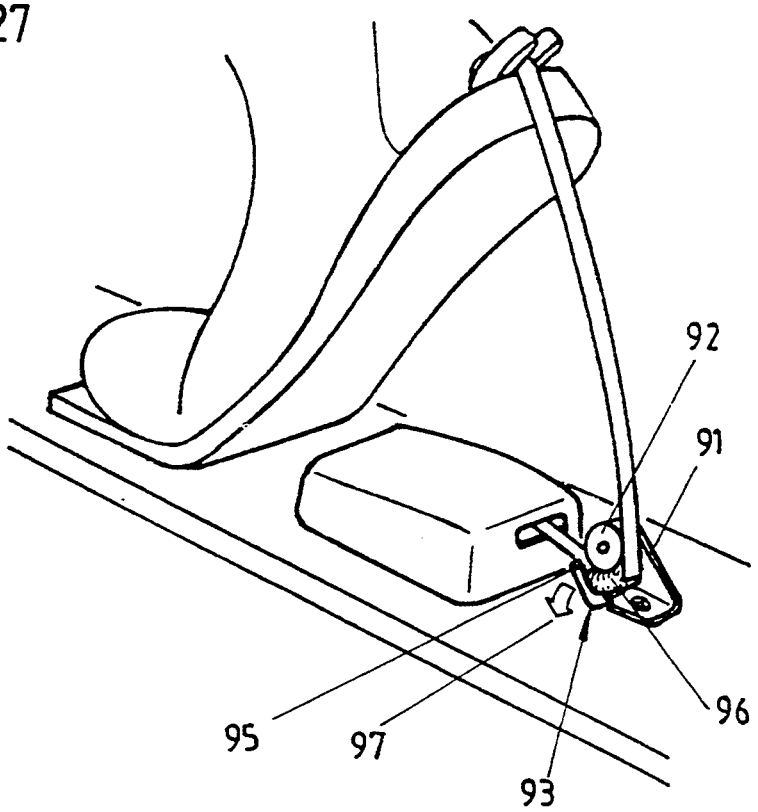
Figure 28:
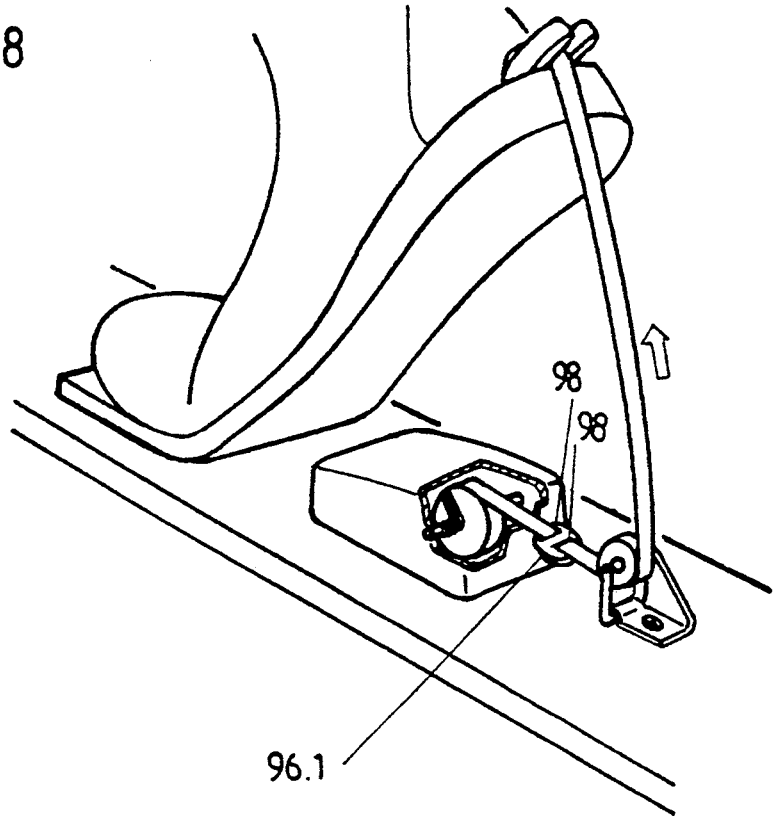
FIGS. 28 and 29 show another embodiment form of a heel holding device in different operating states.
Figure 29:
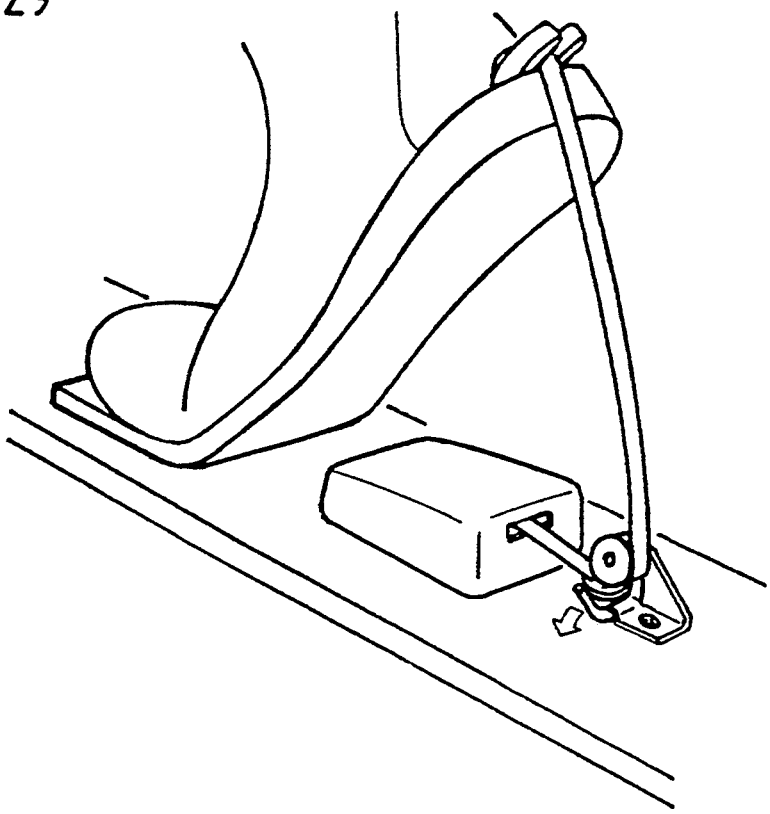

FIGS. 26 to 29 show two similar variants of a construction which are similar to one another. A tension member 27 which can be fixed at the boot heel by means of a clamp 40 is used again and is wound on to a wind-on spool 67 corresponding to the construction according to FIGS. 24 and 25. In contrast to the construction according to FIGS. 24 and 25, the tension member in the embodiment forms according to FIGS. 26 and 29 is guided via a deflecting device 90 which is fixed with respect to the ski and includes a roller 92 which is rotatably supported by means of a mounting 91. A pass-through lock, designated in its entirety by 93, is arranged at this mounting 91 which is fastened to the ski. The pass-through lock 93 has a U-shaped clip whose base 94 is fastened to the mounting and the ski, while the upright legs 95 are constructed so as to be resiliently elastic.

In the construction according to FIGS. 26 and 27 a fixedly arranged thickening 96 is provided on the tension member 27 which is constructed as a ribbon. This thickening 96 is located between the wind-on spool 67 and the pass-through lock 93 during the jumping phase in which the swivel angle of the boot is limited to a determined degree. This thickening 96.1 supported at the pass-through lock 93 and accordingly limits the swivel angle of the boot heel. When increased tensile force occurs during landing, the legs 95 of the pass-through lock 93 are pressed apart in a resilient manner as indicated by the arrow 97 so that the thickening can pass through the pass-through lock 93 and the necessary lengthening of the tension member 27 takes place.

The embodiment form according to FIGS. 28 and 29 differs from that according to FIGS. 26 and 27 only in that the thickening 96 has two slots through which the tension ribbon can be looped so that the thickening is displaceable on the tension member 27 constructed as a ribbon and accordingly adjustable.

While the foregoing description and drawings represent the preferred embodiments of the present invention, it will be obvious to those skilled in the art that various changes and modifications may be made therein without departing from the true spirit and scope of the present invention.

What is claimed is:

1. A ski binding for securing a boot to a ski comprising:

a front sole holding device; and a heel holding device which can be lifted from the ski, said heel holding device including a tension member which is movable in every direction, connects the boot heel with the ski and allows the boot heel to be raised to a height which can be predetermined, said tension member also being voluntarily detachable and permitting release of the connection between boot heel and ski when a tensile force acting on the boot heel exceeds a predetermined value, wherein said heel holding device includes a clamp of resilient material provided at an end of the tension member associated with the boot heel and a cylindrical peg extending vertically relative to a surface of the boot sole, said clamp having two flanges for receiving said peg therebetween in a positive locking manner with the flanges extending transversely relative to a vertical axis of said peg, said clamp adapted to release said peg upon the tensile force exceeding said predetermined value.

* * * * *